United States Patent [19]

Yang

[11] Patent Number: 5,018,288

[45] Date of Patent: May 28, 1991

[54] SOUND ACTIVATED WATER SPOUTING TOY

[76] Inventor: Tsai-Ten Yang, No. 23, Sec. 1, Chung-Hwa W. Rd., Tainan City, Taiwan

[21] Appl. No.: 574,302

[22] Filed: Aug. 28, 1990

[51] Int. Cl.[5] ..... G09F 19/02

[52] U.S. Cl. ..... 40/406; 40/411; 40/414; 446/357

[58] Field of Search ..... 40/406, 409, 410, 414, 40/411; 239/17, 20, 23; 446/156, 159, 267, 358, 265, 357; 272/27 N

[56] References Cited

U.S. PATENT DOCUMENTS

| | | | |
|---|---|---|---|
| 1,113,716 | 10/1914 | Tesla | 239/23 |
| 1,549,204 | 8/1925 | Merigold | 239/20 |
| 2,840,949 | 7/1958 | Faulkner | 446/265 |
| 4,757,986 | 7/1988 | Hwang et al. | 446/136 X |
| 4,923,429 | 5/1990 | Lewis | 40/406 X |

*Primary Examiner*—Kenneth J. Dorner
*Assistant Examiner*—J. Bonifanti
*Attorney, Agent, or Firm*—Darby & Darby

[57] ABSTRACT

A sound activated toy includes a casing having a lower receiving space and an upper receiving space, a sound activated control circuit disposed inside the lower receiving space, a motor similarly disposed inside the lower receiving space and actuated by the control circuit, and a spout enclosure provided in and communicated with the upper receiving space. The spout enclosure is disposed adjacent to the lower receiving space and has a top wall with at least one spout hole. A propeller assembly is confined inside the spout enclosure. A toy figure mechanism is disposed above the spout enclosure inside the upper receiving space. Both the propeller assembly and the toy figure mechanism are moved by the motor. When a predetermined amount of water is received in the upper receiving space and the control circuit starts to actuate the motor, movement of the propeller assembly forces water from the upper receiving space into the spout enclosure so as to generate a water spout at each spout hole.

5 Claims, 3 Drawing Sheets

SOUND ACTIVATED WATER SPOUTING TOY

BACKGROUND OF THE INVENTION

The invention relates to a sound activated toy, more particularly to a sound activated toy which can generate water spouts when actuated.

Sound activated toys are known in the art. An example of such a toy is disclosed in co-pending U.S. Pat. No. 07/496,443 by the applicant. The disclosed toy is a dancing toy doll whose movements are controlled by the sounds it picks up from the surroundings.

SUMMARY OF THE INVENTION

The objective of the present invention is to provide a sound activated toy whose movements are controlled by sounds coming from the surroundings and which is capable of generating water spouts when actuated.

Accordingly, a sound activated toy of the present invention comprises a casing having a hollow seat with a closed top end and an open bottom end, a base attached to the open bottom end of the hollow seat to confine a lower receiving space, and a hollow transparent enclosing wall attached to the closed top end of the hollow seat to confine an upper receiving space. The hollow transparent enclosing wall includes a top wall with a detachable stopper that serves as an access means for water to be poured into the upper receiving space. A sound activated control circuit means is disposed inside the lower receiving space. A motor is similarly disposed inside the lower receiving space and is actuated by the control circuit means. The motor has an axle projecting through the closed top end of the hollow seat into the upper receiving space. A spout enclosure is provided in and communicated with the upper receiving space. The spout enclosure is disposed adjacent to the lower receiving space and has a top wall with at least one spout hole and a central opening. A first propeller is axially disposed inside the spout enclosure and is rotated by the axle of the motor. A second propeller has a diameter larger than that of the first propeller and is similarly disposed inside the spout enclosure. The second propeller is disposed above and is rotated by the first propeller. The second propeller is disposed adjacent to the top wall of the spout enclosure. A gear shaft is mounted to and rotated by the second propeller. The gear shaft extends through the central opening of the top wall of the spout enclosure. At least one gear wheel is disposed above the spout enclosure. The gear wheel is rotatably actuated by the gear shaft and a toy figure is mounted on it. A predetermined amount of water is to be poured into the upper receiving space through the detachable stopper. The control circuit means actuates the motor to move the first and second propellers in order to impel water from the upper receiving space to collect inside the spout enclosure so as to generate a water spout at each spout hole. The hollow seat is transparent and a plurality of colored light bulbs is provided inside the lower receiving space. The light bulbs are similarly actuated by the control circuit means and are provided to enhance aesthetic appeal.

BRIEF DESCRIPTION OF THE DRAWINGS

Other features and advantages of this invention will become apparent in the following detailed description of the embodiment with reference to the accompanying drawings, in which.

DETAILED DESCRIPTION OF THE PREFERRED EMBODIMENT

Figure 1:
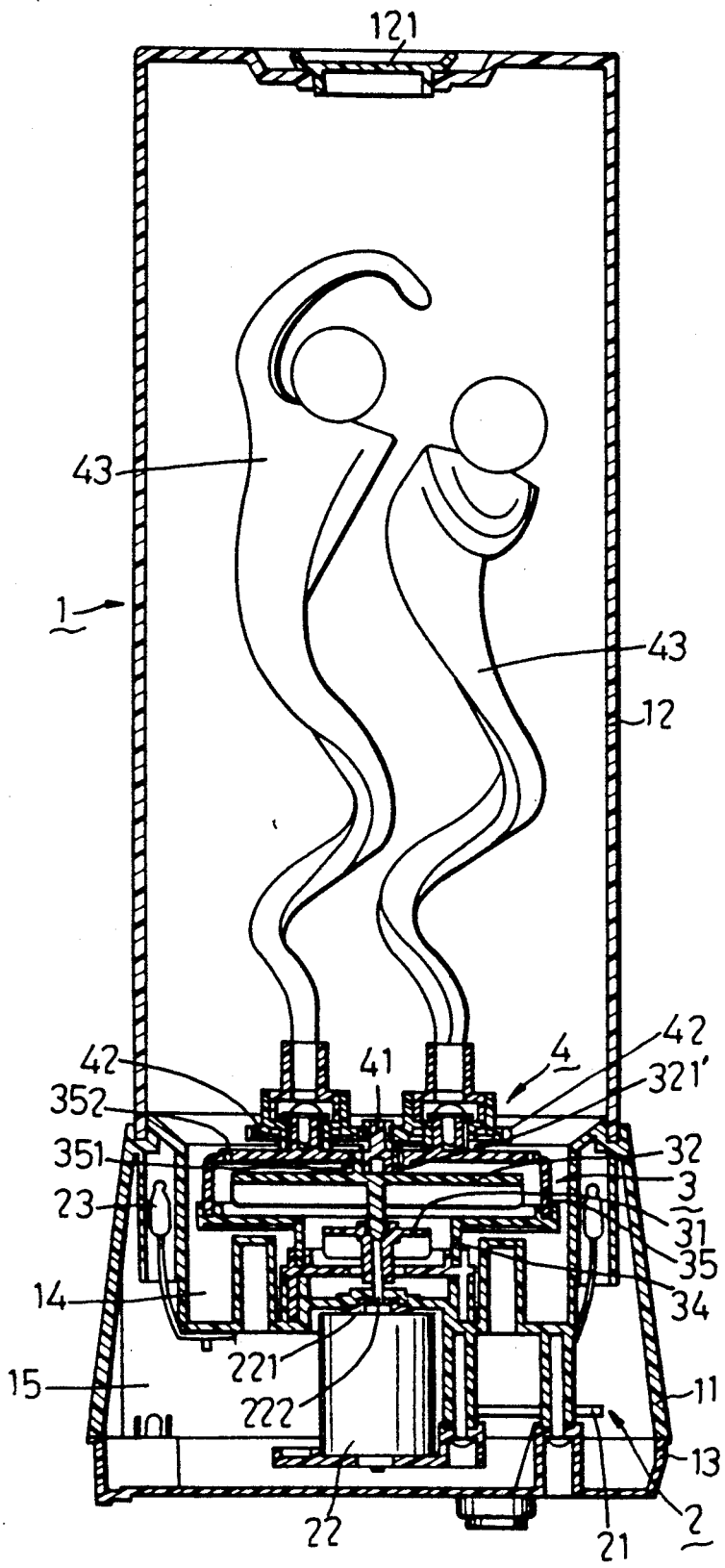
FIG. 1 is a sectional view of the preferred embodiment of a sound activated water spouting toy according to present invention.

Referring to FIG. 1, the preferred embodiment of a sound activated water spouting toy according to the present invention is shown to comprise a casing 1, an electrical control circuit 2, a water spout generating means 3, and a toy mechanism 4.

The casing 1 includes a hollow transparent seat 11, a base 13 attached to the bottom edges of the hollow transparent seat 11 to confine a lower receiving space 15, and a hollow transparent enclosing wall 12 having one end attached to the top end of the hollow transparent seat 11 to confine an upper receiving space 14. The other end of the transparent enclosing wall 12 remote from the hollow transparent seat 11 has a top wall with a detachable stopper 121.

The electrical control circuit means 2 is disposed inside the lower receiving space 15 and includes a sound activated control circuit 21. The control circuit 21 actuates a motor 22 and four colored light bulbs 23. The motor 22 has an axle 222 which extends through the hollow transparent seat 11 into the upper receiving space 14. A sealing member 221 is provided at one end of the axle 222 to prevent leakage of water from the upper receiving space 14 into the lower receiving space 15.

The water spout generating means 3 is disposed inside the upper receiving space 14 and includes a small propeller 31 attached to the axle 222 of the motor 2. The small propeller 31 has a central depression which receives an axial shaft portion of a larger propeller 32. The water spout generating means 3 further includes a lower seat attached to the hollow seat 11 and an upper seat 35 mounted to the lower seat 34. The lower and upper seats 34 and 35 define a spout enclosure that confines the smaller and larger propellers 31 and 32. The spout enclosure is communicated with the upper receiving space 14. The larger propeller 32 has a hollow central annular projection 321' which extends into a central shaft opening 351 formed on a top wall of the upper seat 35. The top wall of the upper seat 35 is slightly spaced from and adjacent to the larger propeller 32 and is provided with several water spout holes 352 near the peripheral edge of the same.

The toy mechanism 4 includes a gear shaft 41 having a portion received in the annular projection 321 and a pair of oppositely disposed gear wheels 42 rotatably actuated by the toothed portion of the gear shaft 41. A toy FIG. 43 is attached to each of the gear wheels 42.

Figure 2:
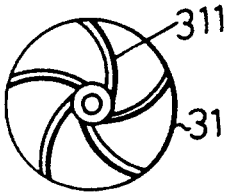
FIG. 2 is a top view of a first propeller of the preferred embodiment.
Figure 3:
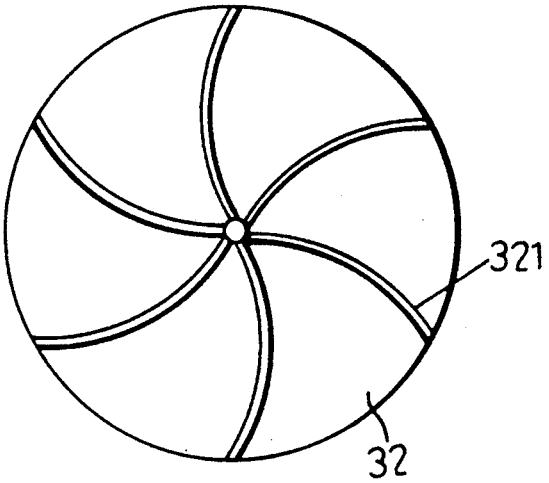
FIG. 3 is a top view of a second propeller of the preferred embodiment.

When using the preferred embodiment, the upper receiving space 14 is filled with a predetermined amount of water. Sounds picked up by the control circuit 21 operate the light bulbs 23 and actuate the rotation of the axle 222 of the motor 22. (A more detailed description of the electrical control circuit means 2 is provided in the succeeding paragraphs). The axle 222 rotates the smaller propeller 31 at a relatively high speed. FIGS. 2 and 3 are top views of the small propeller 31 and the larger propeller 32, respectively. Each of the propellers 31 and 32 has a plurality of arcuate propeller blades 311 and 321 which extend radially outward from the center. The rotation of the smaller propeller 31 agitates the water inside the upper receiving space 14. Water spouts occur at the water spout holes 352 of the upper seat 35 because of the rowing action of the larger propeller 32 and the difference in its speed with respect to the smaller propeller 31 owing to the difference in the diameters. The gear shaft 41 and the gear wheels 42 simultaneously rotate with the larger propeller 32 to cause the rotation of the toy FIGS. 43. The toy FIGS. 43 are designed to create a dancing impression when rotated.

The transparent enclosing wall 12 prevents the escape of water from the upper receiving space 14. Water thus returns to the upper receiving space 14 to allow continuous spouting activity. The stopper 121 is detachable and serves as means for accessing the upper receiving space 14 to increase or decrease the water content of the same.

Figure 4:
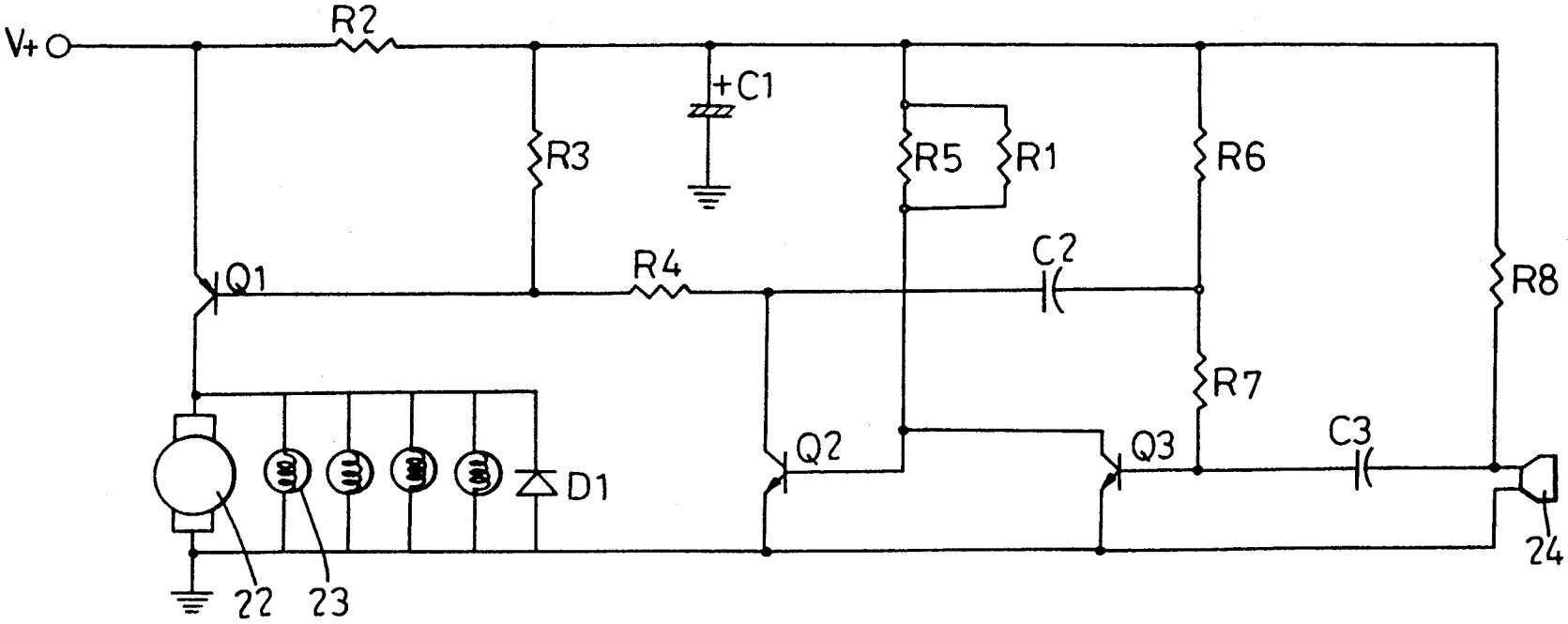
FIG. 4 schematic circuit diagram of the electrical control circuit means of the preferred embodiment.

A schematic circuit diagram of the electrical control circuit means 2 is shown in FIG. 4. The motor 22 is in parallel electrical connection with each of the light bulbs 23. The motor 22 and the light bulbs 23 are connected to the collector terminal of a PNP power transistor Q1. Sound signals received by a high impedance microphone 23 are converted into electrical signals which serve as input to the base terminal of a first NPN transistor Q3. The collector terminal of the first transistor Q3 is connected to the base terminal of a second NPN transistor Q2. Sound signals received by the microphone 23 cause the impedance of the same to drop and force the first and second transistors Q3 and Q2 into a non-conducting state. Current is then supplied to the motor 22 and the light bulbs 23 by the power transistor Q1. As the sound signals diminish, the microphone 23 returns to its original high impedance state and the first and second transistors Q3 and Q2 begin to conduct. A higher voltage output is detected at the collector terminal of the second transistor Q2, forcing the power transistor Q1 into a cut-off condition, thereby stopping the rotation of the toy FIGS. 43 and the generation of water spouts.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A sound activated toy, comprising:

a casing having a hollow seat with a closed top end and an open bottom end, a base attached to said open bottom end of said hollow seat to confine a lower receiving space, and a hollow transparent enclosing wall attached to said closed top end of said hollow seat to confine an upper receiving space, said hollow transparent enclosing wall including an access means for water to be received in said upper receiving space;

a sound activated control circuit means disposed inside said lower receiving space;

a motor similarly disposed inside said lower receiving space and actuated by said control circuit means, said motor having an axle projecting through said closed top end of said hollow seat into said upper receiving space;

a spout enclosure provided in and communicated with said upper receiving space, said spout enclosure being disposed adjacent to said lower receiving space and having a top wall with at least one spout hole;

a propeller means confined inside said spout enclosure and moved by said motor; and a toy figure mechanism disposed above said spout enclosure inside said upper receiving space and similarly moved by said motor;

whereby, a predetermined amount of water is to be received in said upper receiving space through said access means, said control circuit means actuating said motor to move said propeller means in order to force water from said upper receiving space into said spout enclosure so as to generate a water spout at each said spout hole.

2. The sound activated toy as claimed in claim 1, wherein said propeller means comprises:

a first propeller axially disposed inside said spout enclosure and rotated by said axle of said motor; and a second propeller having a diameter larger than said first propeller, said second propeller being axially disposed above and rotated by said first propeller, said second propeller being disposed adjacent to said top wall of said spout enclosure.

3. The sound activated toy as claimed in claim 2, wherein said top wall of said spout enclosure has a central opening, said toy figure mechanism comprising:

a gear shaft mounted on and rotated by said second propeller, said gear shaft extending through said central opening of said top wall;

at least one gear wheel disposed above said spout enclosure and rotatably actuated by said gear shaft; and a toy figure mounted to each said gear wheel.

4. The sound activated toy as claimed in claim 3, wherein said hollow transparent enclosing wall has a second top wall, said access means comprising a detachable stopper provided in said second top wall.

5. The sound activated toy as claimed in claim 3, wherein said hollow seat is transparent, said sound activated toy further comprising a plurality of colored light bulbs disposed inside said lower receiving space and similarly actuated by said control circuit means.

* * * * *